United States Patent [19]

Allen et al.

[11] Patent Number: 4,496,031

[45] Date of Patent: Jan. 29, 1985

[54] MATERIAL HANDLING APPARATUS

[75] Inventors: Ralph E. Allen; Christian D. Gibson, both of Greene, N.Y.

[73] Assignee: The Raymond Corporation, Greene, N.Y.

[21] Appl. No.: 114,911

[22] Filed: Feb. 7, 1980

Related U.S. Application Data

[60] Continuation-in-part of Ser. No. 31,187, Apr. 18, 1979, abandoned.

[51] Int. Cl.[3] ..... B66B 9/20

[52] U.S. Cl. ..... 187/9 R; 414/631

[58] Field of Search ..... 187/9 R, 9 E, 95, 26; 254/143, 144; 414/642

[56] References Cited

U.S. PATENT DOCUMENTS

| | | | |
|---|---|---|---|
| 2,632,530 | 3/1953 | Wagner | 187/9 E |
| 3,061,046 | 10/1962 | Gunning | 187/9 E |
| 3,709,393 | 1/1973 | McGehee | 187/9 E |
| 3,715,014 | 2/1973 | Ohta | 187/9 E |
| 3,727,781 | 4/1973 | Ramsey | 187/9 E |
| 3,830,342 | 8/1974 | Allen | 187/9 E |

*Primary Examiner*—Joseph J. Rolla
*Assistant Examiner*—Kenneth Noland
*Attorney, Agent, or Firm*—Richard G. Stephens

[57] ABSTRACT

A lift truck mast arrangement minimizes stresses occurring in mast members using rearward chain anchor placement to apply a rearward counterbalancing moment to the mast so as to create a bending moment in portions of the mast below the instantaneous position of the load carriage which is substantially equal to the bending moment then occurring in portions of the mast above the load carriage.

17 Claims, 15 Drawing Figures

MATERIAL HANDLING APPARATUS

CROSS-REFERENCE TO RELATED APPLICATION

This application is a continuation-in-part of our prior copending application Ser. No. 31,187 filed Apr. 18, 1979 and now abandoned.

This invention relates to mast arrangements for lift trucks, and more particularly to improved mast and lift chain arrangements which will withstand the imposition of large bending moments in both lateral and longitudinal directions. A number of modern lift trucks include side-shifting carriages capable of shifting a load sufficiently far laterally from a centerline of a mast that large lateral bending moments must be resisted as well as large longitudinal bending moments. In various types of trucks it has been found desirable to interpose various structures longitudinally in between a main truck mast and the load forks, such as an operator platform and/or an auxiliary mast, in addition to side-shifting mechanisms. While such added structures can greatly increase the utility of a truck, they result in such far-forward placement of load center-of-gravity that very large longitudinal load moments occur. A principal object of the invention is to provide an improved mast and chain arrangement which is capable of withstanding large load moments in the longitudinal direction, and in some applications, also in the lateral direction. A brute force approach to the problem might lead one to merely use heavy enough mast members to resist the imposed load moments. The present invention, on the other hand, has the object of providing a mast-chain arrangement which will allow greater bending moments to be resisted with mast members of a given weight or bending modulus. The present invention is in many respects an improvement on mast systems shown in U.S. Pat. No. 3,830,342 issued to Ralph E. Allen, and the present invention incorporates a "crossed-chain" technique shown in the Allen patent for greatly reducing the bending forces which laterally displaced loads otherwise would apply to a mast.

The longitudinal bending moment resulting from a forwardly overhung or cantilevered load is ordinarily applied to I-beam or channel members of a mast as a force couple via sets of rollers engaging flanges of the I beam or channel members. In the most simple and common form of masts, such load moments are resisted by stresses in portions of the mast adjacent the rollers and below the rollers. In the mast of the present invention, as will be seen below, the magnitudes of stresses in portions of the mast below the rollers may be decreased materially by effectively transferring a substantial portion of the stresses to mast portions above the carriage rollers. Roughly speaking, if half the stress is transferred from mast portions below the rollers to mast portions above the rollers, the mast members need only resist half as much bending stress than otherwise, and much lighter members may be used to form the mast. Thus another object of the present invention is to provide an improved mast chain arrangement wherein stresses from longitudinal bending moments are at least roughly equalized between mast portions above and below the force couple applied to the mast via carriage rollers.

Another object of the invention is to reduce the force couple applied to the mast by the carriage.

Other objects of the invention will in part be obvious and will, in part appear hereinafter.

The invention accordingly comprises the features of construction, combinations of elements, and arrangement of parts, which will be exemplified in the constructions hereinafter set forth, and the scope of the invention will be indicated in the claims.

For a fuller understanding of the nature and objects of the invention, reference should be had to the following detailed description taken in connection with the accompanying drawings, in which:

FIG. 1 is a plan view of one form of mast assembly constructed in accordance with the invention.

FIG. 2*a* is a rear elevation view of the mast assembly of FIG. 1, with certain parts omitted.

FIG. 2*b* is a side elevation view of the assembly of FIG. 1, with certain parts omitted.

FIG. 3 is a diagrammatic side-view of a truck which incorporates principles of the invention.

FIGS. 3*a* and 3*b* are graphs useful in understanding certain concepts of the present invention.

Figure 6A:
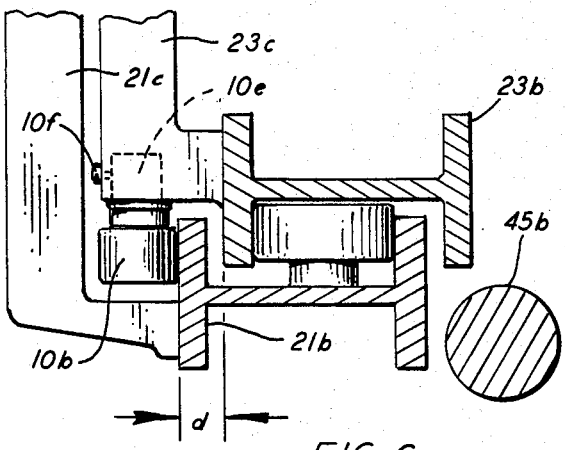
Figure 6B:
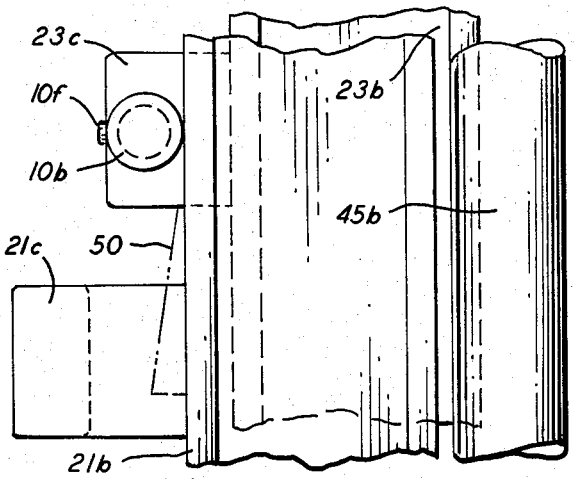
Figure 6C:
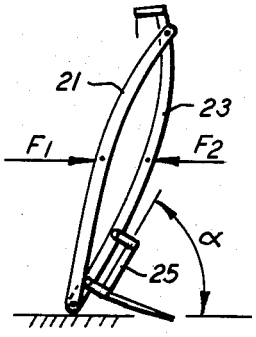

FIGS. 6*a* and 6*b* are detail plan and elevation views illustrating one modification of the invention, and FIG. 6*c* is a diagram useful in understanding operation of the apparatus depicted in FIGS. 6*a* and 6*b*.

Figure 7A:
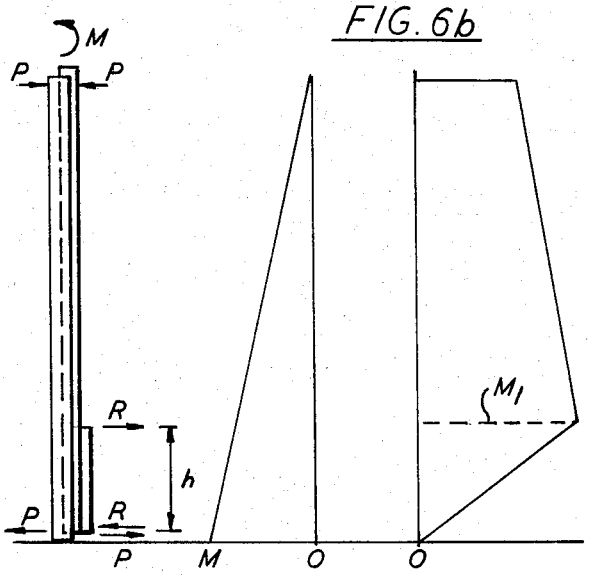
Figure 7B:
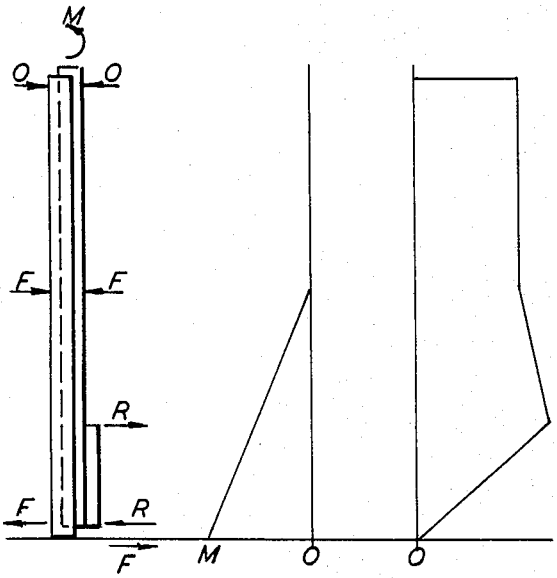
Figure 7C:
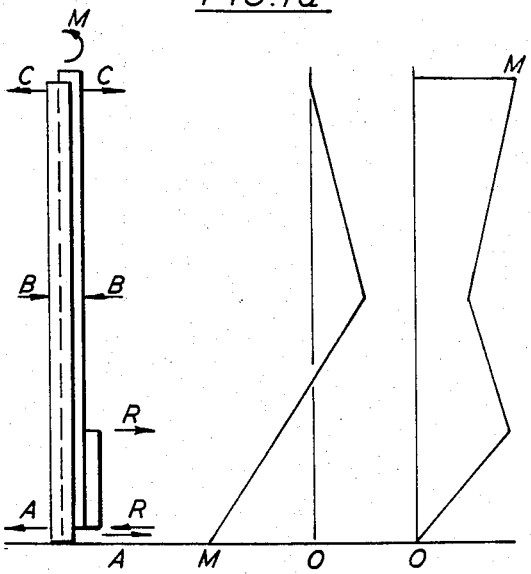

FIGS. 7*a*, 7*b* and 7*c* are diagrams useful in understanding operation of the modification depicted in FIGS. 6*a* and 6*b*.

Figure 8:
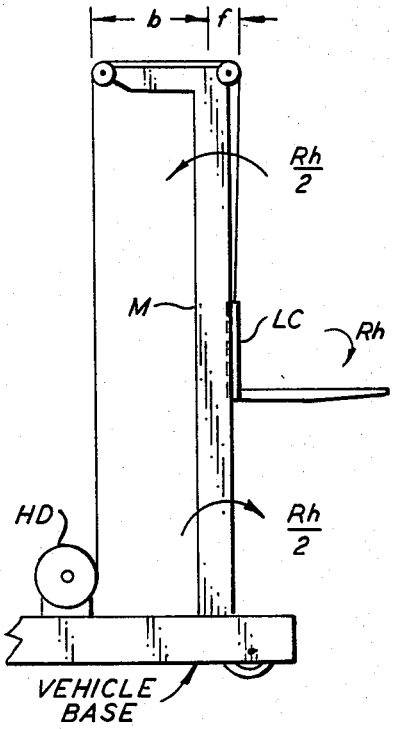

FIG. 8 diagrammatically illustrates another form of the invention.

Figure 1:
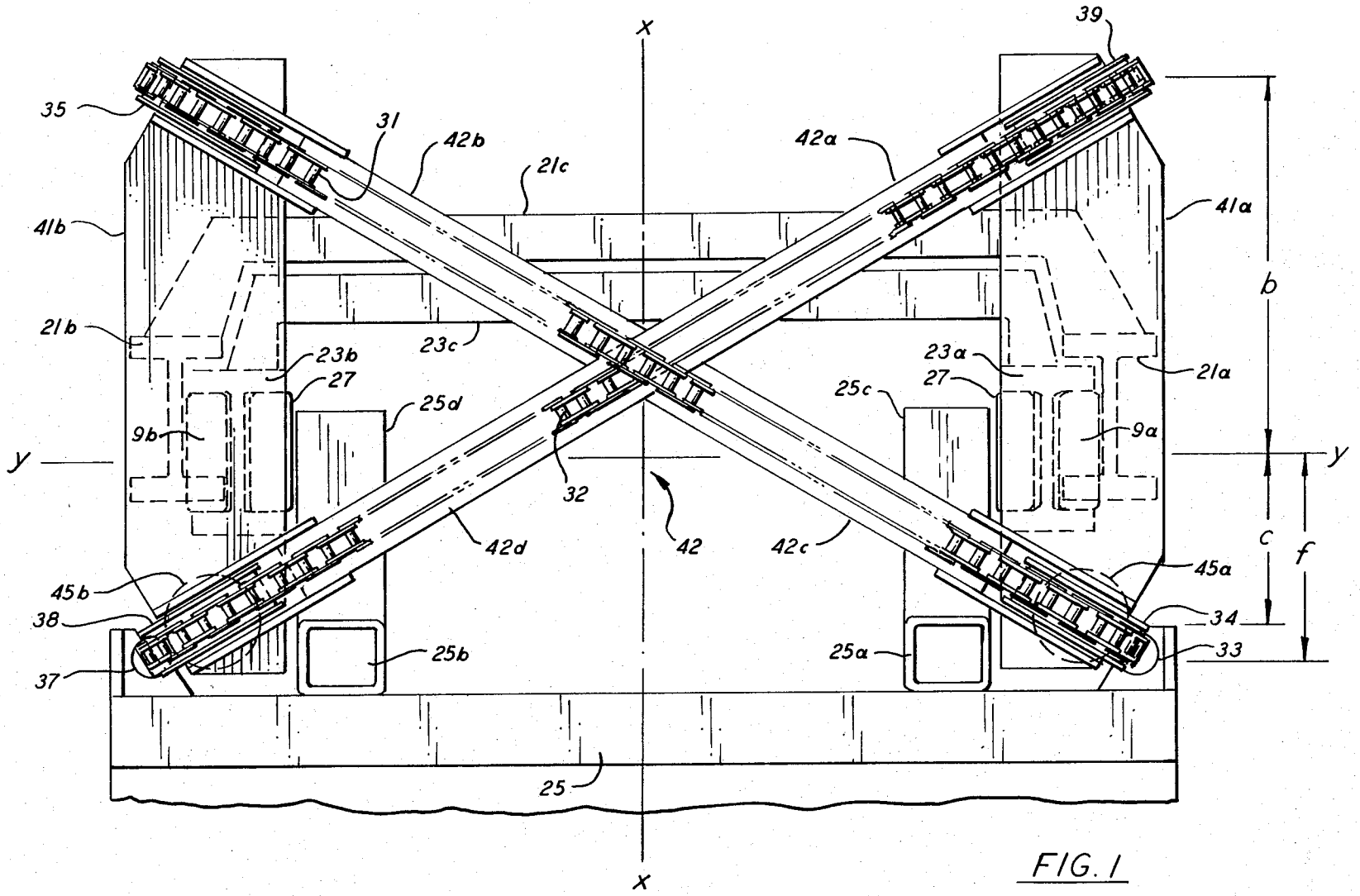
Figure 2A:
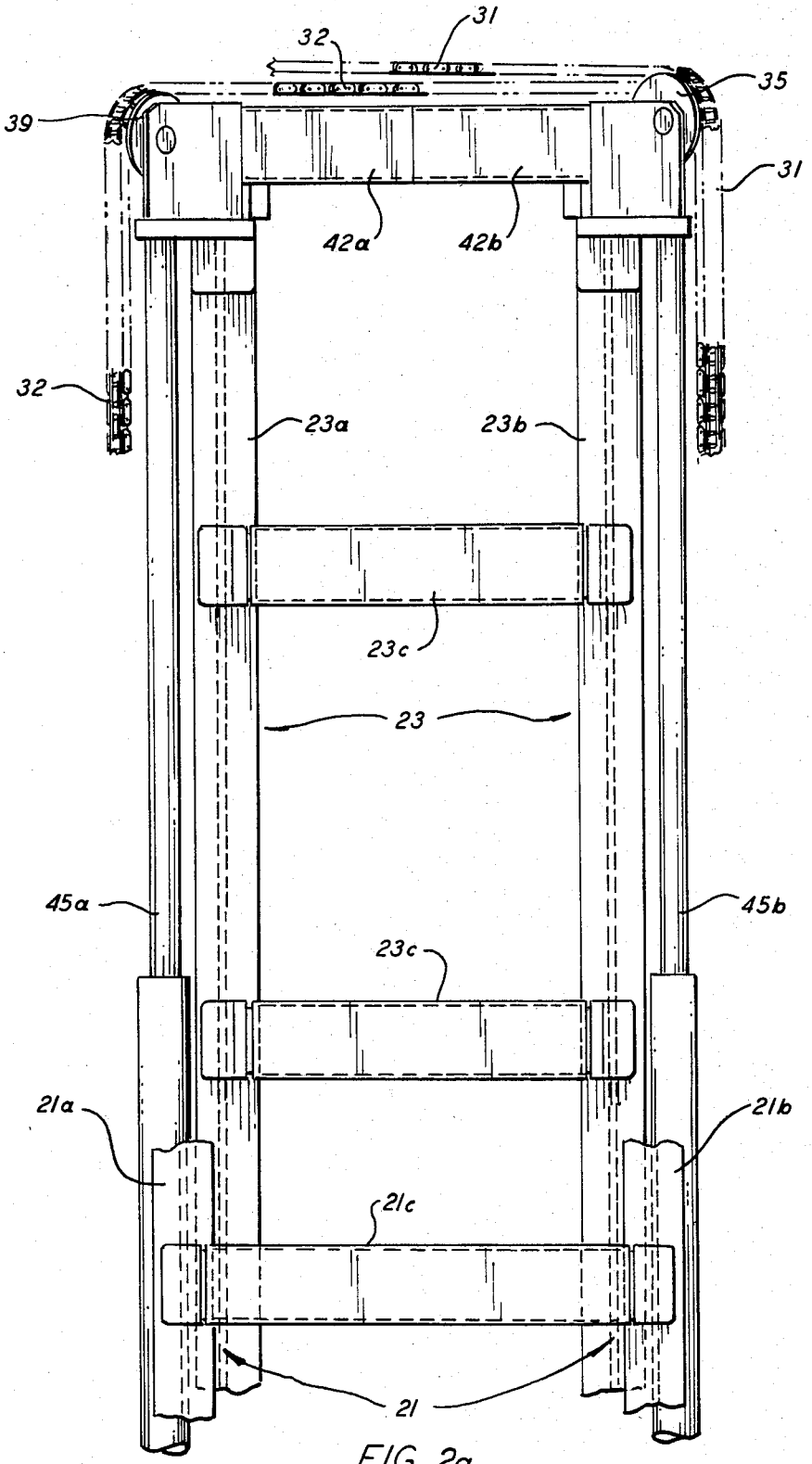
Figure 2B:
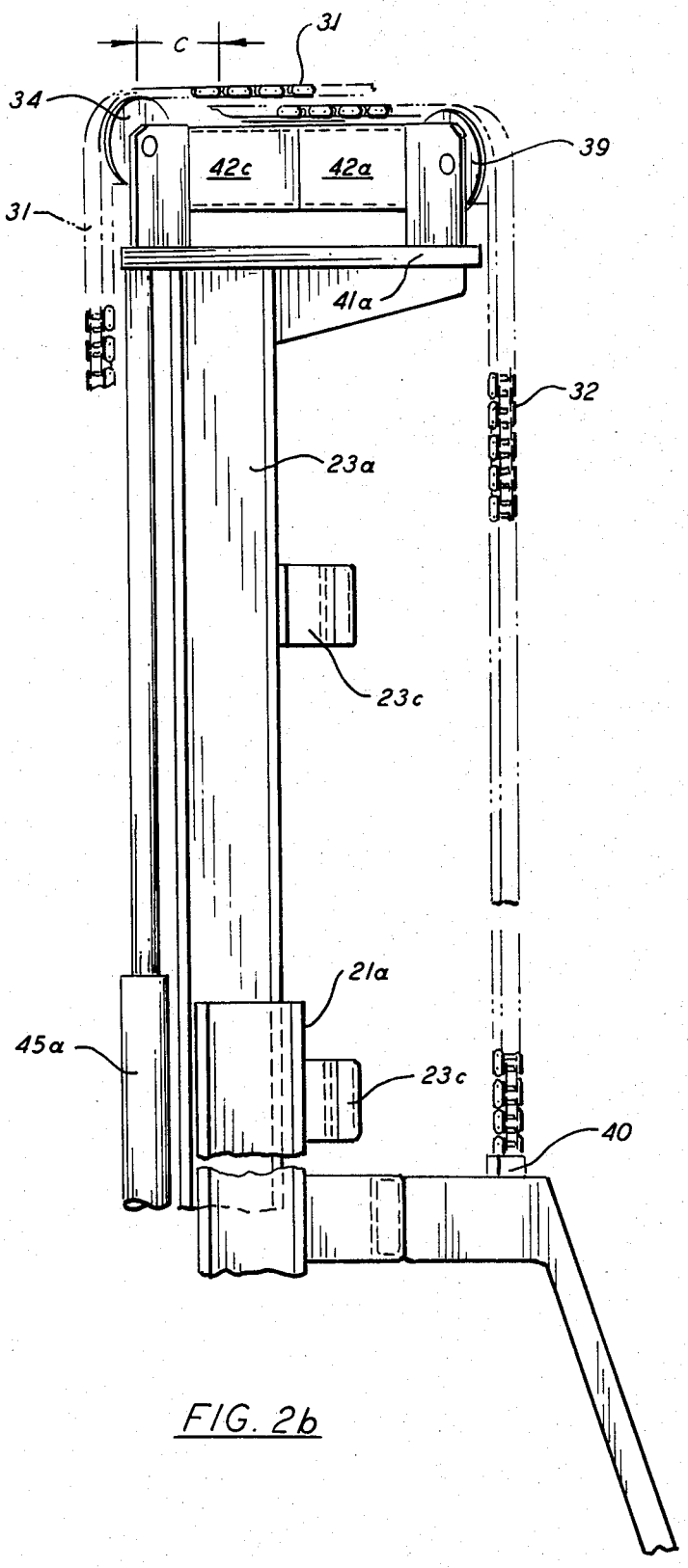

Referring to FIGS. 1, 2*a* and 2*b*, the mast is shown as comprising a stationary lower section 21 formed by I-shape members 21*a*, 21*b* which are affixed to the base (not shown) of the vehicle in conventional manner, and an elevatable section 23 comprising I-shape members 23*a*,23*b*. Fixed mast members 21*a*,21*b* are shown in FIG. 1 spaced apart on a lateral axis y—y on opposite sides of a longitudinal axis x—x, and interconnected by cross-ties 21*c*. Rollers 24,24 (FIG. 3) journalled on elevatable members 23*a*,23*b* near the bottoms of such members ride in the inner recesses between flanges of fixed members 21*a*,21*b*, and rollers 9*a*,9*b* journalled on fixed mast members 21*a*,21*b* near the tops of such members ride in recesses between flanges of elevatable members 23*a*,23*b*, guiding the elevatable mast section for vertical travel in conventional fashion. A plurality of tie members 21*c* extend between vertical members 21*a*,21*b* to provide rigidity in the fixed mast section, and a plurality of tie members 23*c*,23*c* extend between vertical members 23*a*,23*b* to provide rigidity in the elevatable mast section. An elevating carriage 25 (FIG. 1) comprises a pair of vertical members 25*a*,25*b* (shown as box sections) from which brackets 25*c*,25*d* extend rearwardly to carry carriage rollers 27,27. The carriage rollers nest in the inner recesses between flanges of elevatable members 23*a*,23*b* to guide the carriage for vertical movement. The carriage 25, which is only partially shown in FIG. 1, may take a variety of different forms in different applications of the invention. It may include, for example, a mechanism which laterally shifts a load, a longitudinal reach mechanism, a mechanism which rotates a load about a vertical axis, a mechanism such as an auxiliary mast which may further lift or lower a load, an operator station, or any desired combinations of such devices, and various forms of fork carriages. In any event the lift carriage will support a payload in cantilever fashion so that a substantial force couple will be applied to the mast via the carriage rollers. As best seen in FIG. 1, four pulleys 34,35,38,39 are mounted atop the elevatable mast section, being spaced in a rectangular array with pairs of pulleys facing each other diagonally across the top of the elevatable mast section. Bracket 41*a* carried atop elevatable member 23*a* carries pulleys 34 and 39, while bracket 41*b* carried atop elevatable member 23*b* carries pulleys 35 and 38. An X-shaped support 42 formed of box section has arms 42*a*–42*d* extending diagonally between pairs of the pulleys to maintain the pulleys spaced apart when forces are applied to the pulleys by the lift chains 31,32.

Carriage 25 is shown suspended on the mast by lift chains 31,32 each of which is routed over a respective pair of pulleys mounted atop the elevatable mast section. Lift chain 31 extends upwardly from anchor means 33 on carriage 25, over pulley 34, across the top of the elevatable mast section and pulley 35, and thence downward to an anchor point which is fixed relative to the stationary mast section, thereby crossing both axis x—x and axis y—y. Lift chain 32 extends upwardly from anchor means 37 on carriage 25, over pulley 38, across the top of the elevatable mast section, passing just beneath chain 31, over pulley 39, and thence downward to anchor point 40 (FIG. 2*b*) fixed relative to the stationary mast section, thus also crossing both axis x—x and axis y—y. A pair of hydraulic lift cylinders 45*a*,45*b* are mounted on the truck base, and their rams are connected to raise and lower the elevatable mast section. The rearward anchor points (such as 40) of the lift chains may be located on brackets attached to the stationary mast section; they may extend to the base frame of the vehicle, or they may extend to other structures which do not move vertically relative to the base frame of the vehicle. In FIG. 2*b* the chains are shown anchored on an overhead brace structure.

In FIG. 1 the axis y—y defines a longitudinal centerline of elevatable mast members 23*a*,23*b*. The operating axes of rams 45*a*,45*b* are each shown located a distance c forwardly from axis y—y. In accordance with one concept of the present invention dimension c is made as large as is practically possible without increasing an effective load center-of-gravity dimension x to be discussed, so that the operating axes of the rams lie as far forward in front of the mast as possible. In FIGS. 1 and 2*b* the axes of the rams lie clearly forward of any portions of the mast vertical members 21*a*,21*b*,23*a*,23*b*. In applying the principles of the invention to a three-section or four-section mast one might not locate the ram axes forwardly from all portions of the uppermost sections, but still forwardly from the two lowermost sections. As will become clear below, maximizing dimension c acts to counteract the portion of the forward bending moment attributable to the tension in the lift chains. The anchor points 33 and 37 of the lift chains on carriage 25 are each shown located a distance f forwardly from axis y—y.

In accordance with another concept of the present invention dimension f is made as large as is practical, connecting the forward vertical courses of the lift chains as far forward as possible on the carriage. That requires, of course, that pulleys 34 and 38 be located sufficiently forward. The maximum achievable f dimension tends to be limited by the rear face of the load carried on the load carriage in most applications. As will become clear below, maximizing dimension f results in an appreciable reduction in the magnitude of the force couple applied to the mast by the carriage rollers. The anchor points of the lift chains on stationary structure are each shown located a distance b rearwardly from axis y—y.

In accordance with a further concept of the invention, a counterbalancing moment in the rearward direction is induced by provision of a substantial dimension b, locating the lift chain anchor points (e.g. 40) and pulleys 35 and 39 sufficiently rearwardly from axis y—y. It may be noted that the broad idea of producing a counterbalancing moment by rearward chain placement is not new, such a technique being shown, for example, in U.S. Pat. No. 3,727,781. However, that prior art system contemplated use of a counterbalancing moment which produced substantially zero bending moment in mast portions below the instantaneous positions of its load carriage. Such an arrangement disadvantageously tends to cause maximum possible stresses in mast portions above the instantaneous position of the load carriage. As will become clear below, provision of the proper distance b allows one to equalize the stresses in upper and lower portions of the mast for a given payload, and such equalization results in the least possible stresses. In most applications of the invention dimension b will be selected so that stresses are equalized for a maximum rated payload or a "typical" payload near the rated maximum. The anchor points 33 and 37 on the carriage are shown laterally spaced apart at a distance slightly exceeding the lateral spacing of the lift cylinders and the lateral spacings of the vertical mast members, both fixed and elevatable, but in some embodiments of the invention, and in particular those which incorporate wider carriages or provide for greater lateral load shifting, the four pulleys and four chain anchor points may be located greater lateral distances from axis x—x. It is sometimes desirable that the rams be located as far apart as possible, near the lateral extremities of the base frame of the truck, but the lateral spacing of the rams is in no way critical. Locating the ram axes substantially directly below the forward pulleys 34 and 38 does however eliminate force couples which otherwise would appear in brackets 41*a*,41*b* of the elevatable mast section and thereby allows the use of lighter construction. In one successful embodiment of the invention, dimension c was 6.75 inch (17.15 cm.), dimension f was 8.0 inch (20.32 cm.) and dimension b was 14.25 inch (36.2 cm.), where the lateral spacing between the pairs of anchor points was 46 inches (116.34 cm.).

Figure 3:
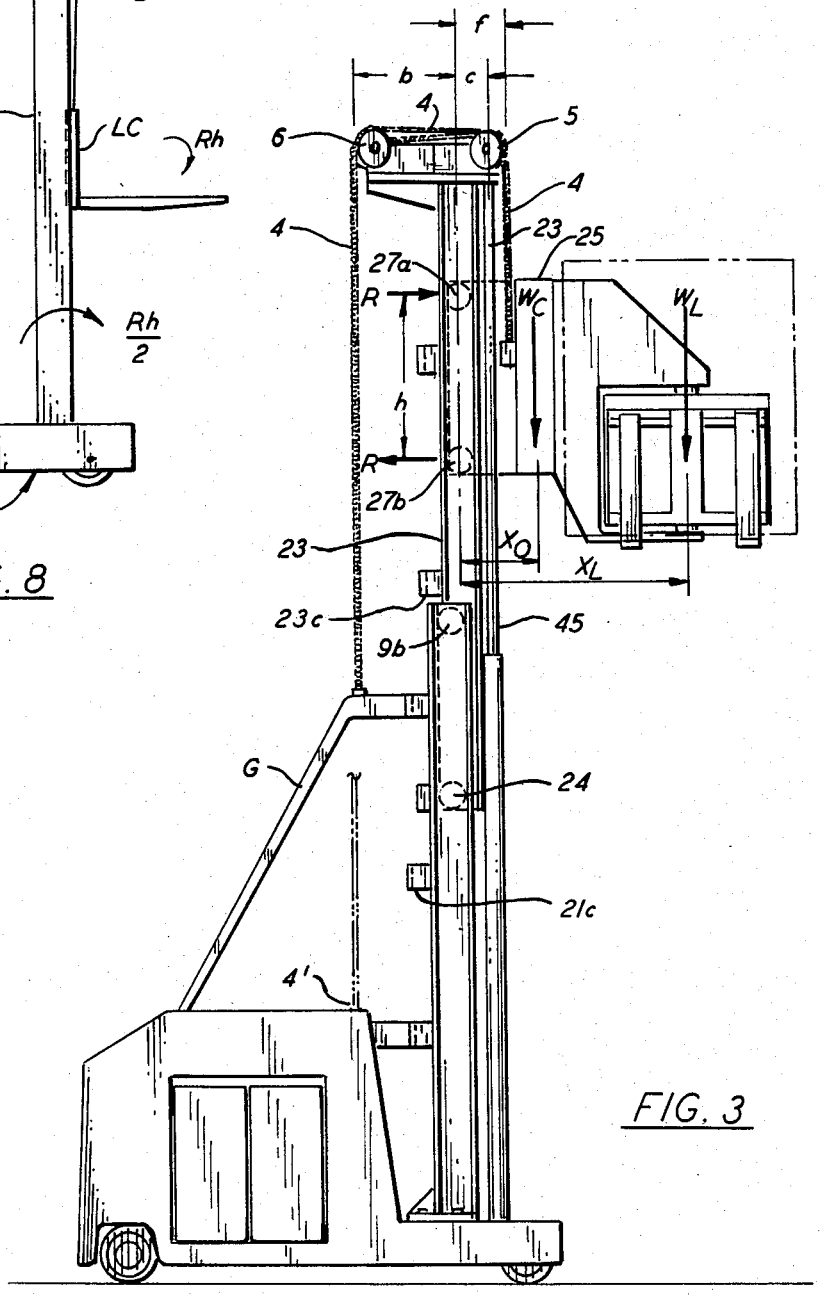

The principles of operation of the structure of FIGS. 1, 2*a* and 2*b* can be better understood by reference to FIG. 3. In the diagram of FIG. 3 the mast upper section 23 is supported atop lifting ram means 45 which engage the mast a distance c forward from a centerline of the mast. Carriage means 25 has upper and lower rollers 27*a*,27*b* spaced distance h apart and guided between flanges of mast section 23, and forks which carry a payload having a weight identified by vector $W_L$. The empty weight of the carriage is indicated by vector $W_c$. The carriage is suspended by lift chain means 4, which passes over sheaves 5 and 6 atop the mast and is anchored to the base of the truck. Sheaves 5 and 6 are longitudinally spaced apart so that the rearward vertical course of chain means 4 is spaced distance b rearwardly from the centerline of the mast. The weight vectors $W_L$ and $W_c$ apply a clockwise moment to the mast, resulting in roller forces R,R. It will be understood that assumption of a single lift chain in the following analysis of FIG. 3 in lieu of the pair of crossed lift chains shown in FIG. 1 renders FIG. 3 inappropriate for analysis of lateral moments in FIG. 1, but that FIG. 3 follows the principles of FIG. 1 insofar as longitudinally acting moments are concerned.

The center of gravity of the empty carriage weight is located a fixed distance $x_o$ forwardly from the mast centerline, and the center of gravity of the payload $W_L$ is located distance $x_L$ forwardly from that centerline. The moments $W_c x_o$ and $W_L x_L$ may be combined and expressed as a resultant moment Wx expressed in terms of a resultant weight W and its resultant center-of-gravity distance x, where:

$$Wx = W_c x_o + W_L x_L \tag{1}$$

Taking the mast together with the carriage as a free body, with clockwise moments being assumed positive, one can show that the bending moment $M_L$ in the portion of the mast below the carriage is given by:

$$M_L = Wx - Fc - Tb \tag{2}$$

where F is the force on the ram means 45 and T is the tension in the lifting chain means.

Taking the section of the mast above the carriage as a free body, one can show that the bending moment $M_u$ in the mast above the carriage is given by:

$$M_u = T(f-b) - Fc \tag{3}$$

The force couple Rh applied to the mast by the carriage is equal to the difference between the bending moments in the lower and upper sections of the mast, so that:

$$Rh = M_L - M_u = Wx - Tf \tag{4}$$

Chain tension T will be seen to equal weight W, and the force F on the ram equals 2W plus $W_m$, the weight of the elevatable mast, so that one can re-write equations (2) through (4) as follows:

$$M_L = W(x-2c-b) - W_m c = (W_L + W_c)(x-2c-b) - W_m c \tag{2a}$$

$$M_u = W(f-2c-b) - W_m c = (W_L + W_c)(f-2c-b) - W_m c \tag{2b}$$

$$Rh = W(x-f) = (W_L + W_c)(x-f) \tag{2c}$$

It becomes apparent from equation (2c) that the force couple Rh which the carriage rollers apply to the mast will be proportionately reduced as dimension f is increased, and would even become zero if it were possible to connect the chains to the carriage as far forward from the mast as the resultant center-of-gravity distance x. If one increases dimension f however, it can be seen from equation (2b) that the bending moment in the upper portion of the mast will proportionately increase.

It may be seen from equations (2a) and (2b) that placing the lifting rams as far forwardly as possible to increase dimension c advantageously decreases the moments in both the upper and lower mast sections, and that establishing the rear vertical chain courses as far rearwardly to provide a substantial dimension b advantageously decreases the moments in both the upper and lower mast sections.

By solving equation (2a) for b with $M_L$ set at zero one finds that the bending moment in the lower portion of the mast will be zero if $$b = x - 2c - \frac{W_m c}{W_L + W_c} \tag{5}$$

but if one then inserts that value of b into equation (2b) it is found that the moment $M_u$ in the upper portion of the mast then becomes very large, as indicated by:

$$M_u = (W_L + W_c)(f-x) \tag{6}$$

Similarly, the bending moment in the upper portion of the mast will become zero if $$b = f - 2c - \frac{W_m c}{W_L + W_c} \tag{7}$$

but the moment in the lower portion of the mast then will become very large:

$$M_L = (W_L + W_c)(x-f) \tag{8}$$

The magnitudes of the moments given by equations (6) and (8) will be seen to be equal, but the moments to be of opposite sign. Thus use of the b dimension given by equation (5) results in the large negative or rearward bending moment of (6) being applied to the upper portion of the mast, while use of a b dimension given by equation (7) results in the large positive or forward bending moment of (8) being applied to the lower portion of the mast.

While use of the b dimensions given in (5) and (7) result in very large moments in one portion or the other of the mast, tending to make use of either of those values impractical for most applications, one should appreciate from the above that varying the b dimension in effect allows one to transfer stress from one portion (upper or lower) of the mast to the other portion.

Now, in accordance with a further concept of the present invention, if one chooses to establish the b dimension so that $M_L$ will be equal in magnitude to but opposite in sign from $M_u$, one may write:

$$W(x-2c-b) - W_m c = -W(f-2c-b) + W_m c \tag{9}$$

Solving equation (9) for b gives:

$$b = \frac{x}{2} + \frac{f}{2} - c\left(2 + \frac{W_m}{W}\right) \tag{10}$$

Combining equations (1) and (10) and recognizing that $W = W_c + W_L$, one may derive:

$$b = \frac{f}{2} - 2c + \frac{W_c x_o + W_L x_L - 2W_m c}{2(W_c + W_L)} \tag{11}$$

By selection of the b dimension in accordance with expression (11), one causes upper and lower mast portions to equally share bending moments, thereby resulting in mimimum stress for both mast portions.

Figure 3B:
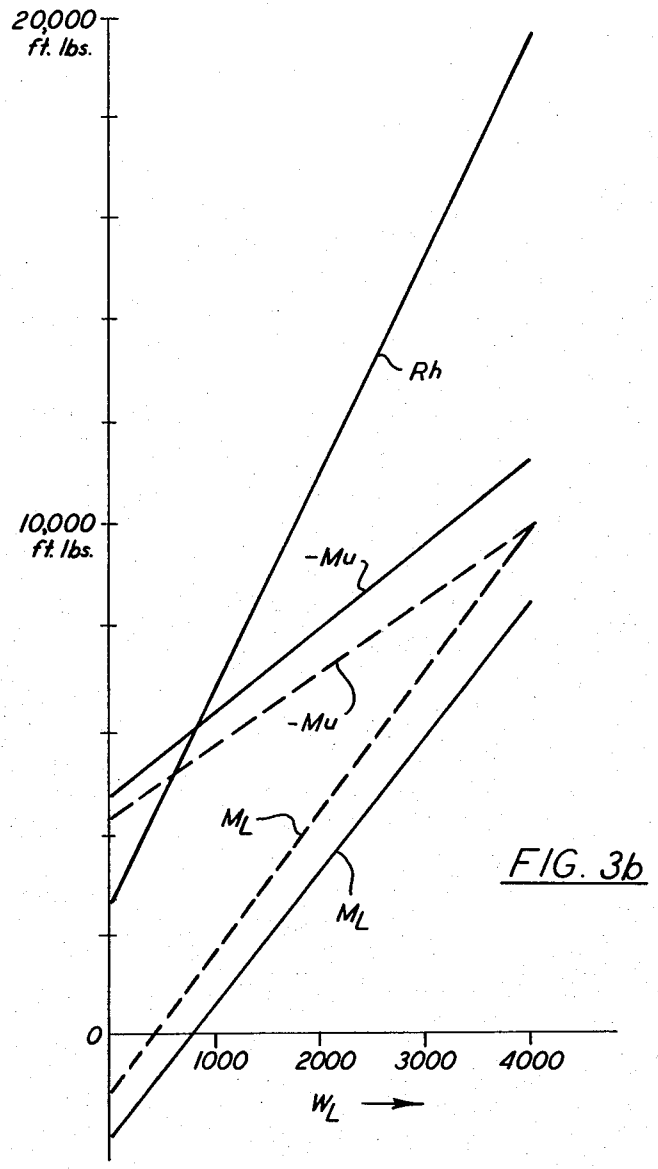
Figure 3A:
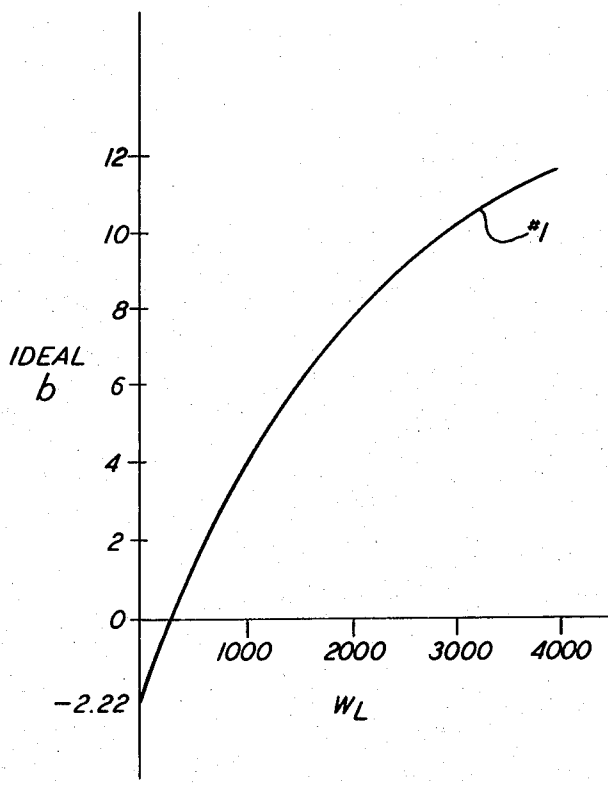

Assuming values $W_m = 1000$ lbs.(454 kg.), $W_c = 2500$ lbs.(1134 kg.), $x_o = 20$ inches (50.8 cm.), $x_L = 60$ inches (152.4 cm.), $f = 8.0$ inches (20.32 cm.) and $c = 6.75$ inches (17.15 cm.), the quantity b given by equation (11) varies with payload as shown by curve #1 in FIG. 3*a*. One may note that curve #1 has decreasing slope at larger values of $W_L$, and hence a b dimension selected for a payload somewhere near maximum will be approximately correct for a range of payloads. Equation (11) gives the dimension b which will provide equal upper and lower bending moments $M_u$ and $M_L$, and if $M_u$ and $M_L$ are both equal in magnitude, they will have minimum magnitudes for a given payload. Since the absolute values of $M_u$ and $M_L$ will be largest when a maximum rated payload $W_L$ is being handled, the distance b in practice ordinarily will be selected to be equal or nearly equal to the value given by equation (11) with maximum payload assumed. With a given value selected for b, the moments $M_L$, $M_u$ and Rh are readily calculated from equations (2a) to (2c). Curves shown in FIG. 3*b* in solid lines illustrate how these three moments vary with the values assumed above with b=14.25 inches (36.2 cm.). The $M_u$ moment is opposite in sign to the $M_L$ moment during most payload conditions, but it has been plotted with reversed sign in FIG. 3*b* to facilitate comparison of the magnitudes of the $M_u$ and $M_L$ bending moments. It will be seen that the moment in the upper portion of the mast exceeds that in the lower portion and at an assumed maximum payload of 4000 lbs. becomes −11,260 ft. lbs., while that in the lower portion reaches 8673 ft. lbs. Curves shown in dashed lines indicate how $M_u$ and $M_L$ would vary if b were 11.77 inches (29.9 cm.) instead of 14.25 inches (36.2 cm.). Both portions of the mast receive maximum bending moments of 9917 ft.lbs. when the payload is 4000 lbs. The Rh carriage couple values are not affected by distance b, which is apparent from equation (2c). It may be noted that when the b dimension has been selected in accordance with equation (11) for a given payload, each of the moments $M_L$ and $M_u$ will be equal in magnitude to one-half of the force couple Rh when that payload is carried. It should be apparent now that distance b need not be selected to provide exactly equal moments in upper and lower mast portions, though greater benefits are attained the more nearly they are equalized. It is contemplated that in typical applications of the invention the lower moment will be arranged to be within 70 percent to 130 percent in magnitude of the bending moment then occurring in portions of the mast assembly above the instantaneous position of the load carriage.

Figure 4:
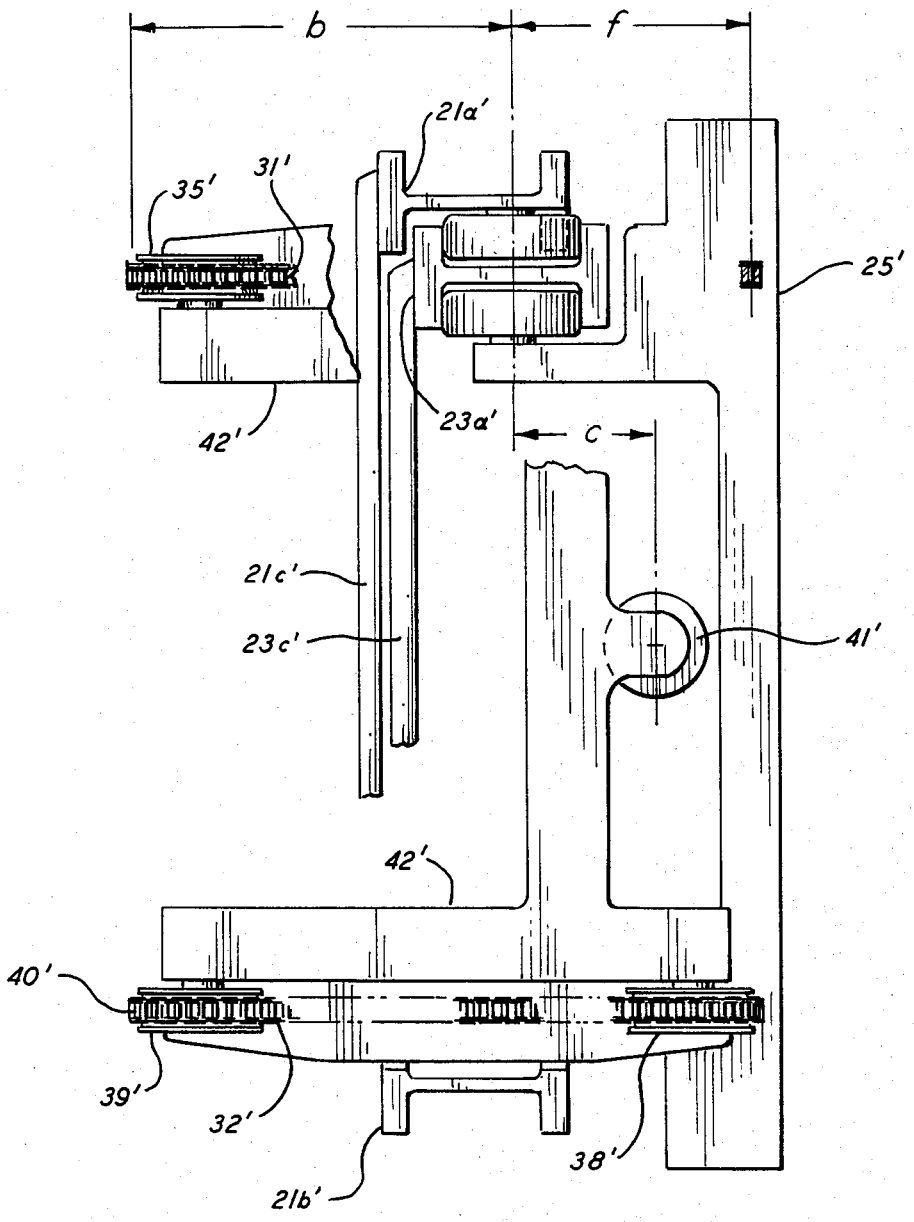
FIG. 4 is a plan view of an alternative embodiment of the invention.

One may note that the diagram of FIG. 3 and the equations developed in connection therewith deal solely with longitudinal bending moments. The lateral crossing of the lift chains in the manner shown in FIG. 1 importantly serves to reduce lateral bending moments, however, in a manner fully described in the mentioned Allen patent. It should be noted, however, that major concepts of the invention are applicable to mast assemblies wherein the lift chains do not cross the x-x axis, but instead are trained to extend only longitudinally across the y-y axis. Such an arrangement is illustrated in FIG. 4. Four pulleys, only three of which are shown at 35',38' and 39', are mounted on bracket means 42' (shown partly cutaway) carried atop the elevatable mast section, one vertically-extending member of which is shown at 23*a'*. The elevatable mast section is guided for vertical movement in conventional manner by a fixed mast section, the two vertically-extending members of which are shown at 21*a'* and 21*b'*. The carriage 25' is guided for vertical movement in conventional fashion by the elevatable mast section. Chain 32' extends upwardly from carriage 25' over pulleys 38' and 39' and thence downwardly to an anchor point 40' vertically fixed relative to the truck base, and chain 31' extends upwardly from carriage 25' over pulleys 34' (not shown) and 35' and thence downwardly to another anchor point vertically fixed relative to the truck base. Dimensions c,f and b are shown in a manner similar to FIGS. 1–3. Moments in the upper and lower sections of the mast of FIG. 4 can be equalized using the same concept applied in connection with FIGS. 1–3. In FIG. 4 a single laterally centered lifting ram 41' is shown in lieu of a pair of spaced-apart rams, but a spaced-apart pair could be used. It is also important to recognize that a single laterally centered ram could be used in the assembly shown in FIGS. 1–3. Where a pair of laterally spaced-apart rams are used, it is contemplated that they will be connected to hydraulically communicate with each other so as to provide equal ram forces, as was discussed in the Allen patent.

In referring to portions of the mast below the load carriage, reference is being made to those portions from the lower carriage rollers down to a location where the mast is substantially rigidly connected to the base frame, and the ends of lift chains should be connected at least that low, or lower on the base frame. In FIG. 3 chain means 4 is shown connected to a rigid brace G which is connected to the mast and base frame. The chain could instead be connected to a lower point on the vehicle as indicated at 4'.

It may be noted that moment equations (2a) to (2c) do not depend upon use of a reference axis (such as y-y) corresponding to the centroids or neutral axes of the elevatable members 23*a*,23*b*, and that equivalent equations can be derived wherein the distances to the vertical chain courses, the ram axes and the centers-of-gravity are measured from various other laterally-extending reference axes.

Figure 5:
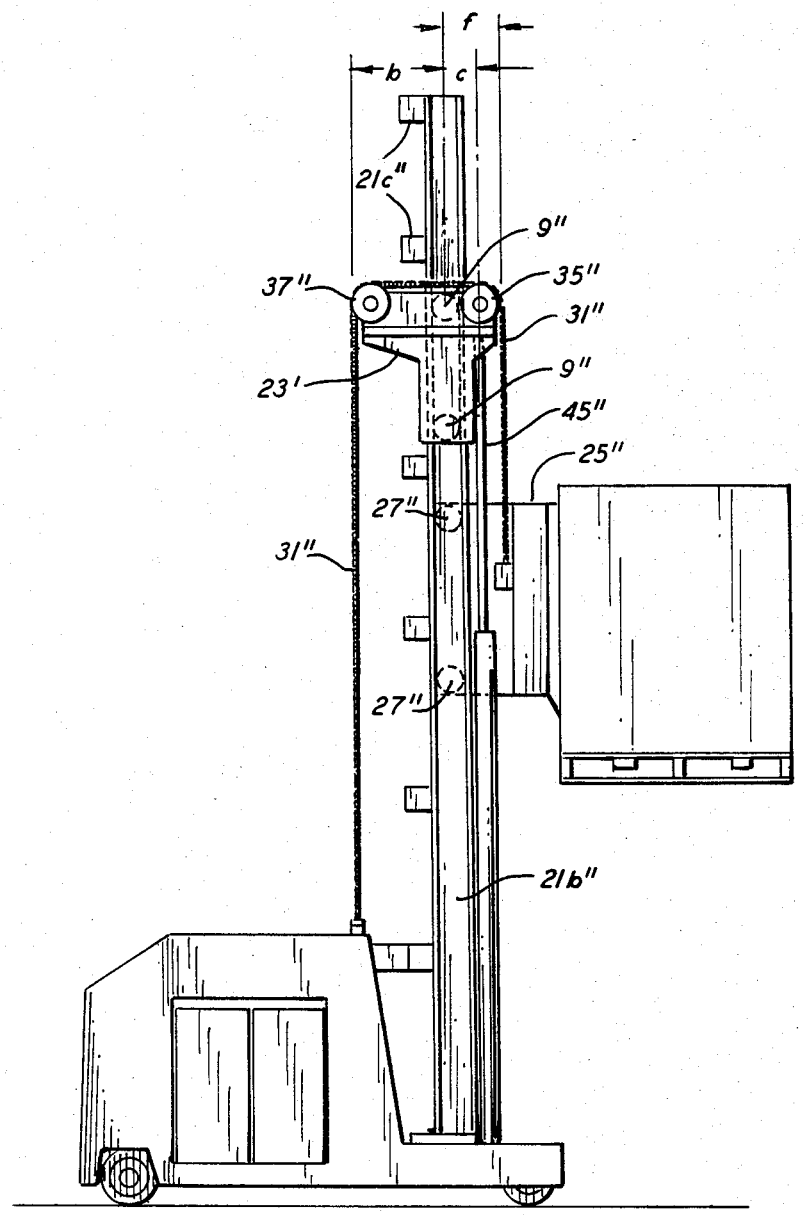
FIG. 5 is a side elevation view of a further embodiment of the invention.

It is not necessary that the elevatable mast section which carries the pulleys be an elongate structure or be extendable above the top of the fixed mast section, nor is it necessary that the carriage be guided for vertical movement by the elevatable mast section. In FIG. 5 carriage 25'' is guided for vertical movement by the fixed mast section, one vertically-extending member of which is labelled 21*b''*. The elevatable mast section 23' is raised and lowered by ram 45'', and rather than comprising an elongate structure extendable to protrude above the top of the fixed mast section, elevatable section 23' merely carries a pair of pulleys (e.g. 35'',37'') for the lift chains on each side of the mast. Elevatable mast section 23' is guided along the fixed mast section by rollers 9'',9'' nested in the outer recesses of the fixed mast section and journalled on the elevatable section. The lift chains, one of which is visible at 31'', each extend straight rearwardly over respective pairs of pulleys on the elevatable section and thence downward to anchor points fixed relative to the base frame. The elevatable mast section has an upper limit of travel at which its upper rollers 9'' lie at the upper end of the fixed mast section, and a lower limit of travel approximately halfway down the fixed mast section. In the embodiment of FIG. 5 wherein the elevatable mast section is suspended on the outer sides of the fixed mast section, the chains cannot cross laterally to reduce lateral bending moments if cross ties such as those shown at 21*c''* are provided at places along the upper half of the fixed mast section. In FIG. 5, the upper bending moment $M_u$ occurs only in the portion of the mast between the upper rollers 27'' on the carriage and the lower rollers 9'' on the elevatable mast section. The magnitude of the moment decreases linearly to zero above the lower rollers 9'' up to the upper rollers 9'', and remains zero thereabove.

Equalizing bending moments in the upper and lower mast portions will also provide the smallest maximum stress in the mast if both mast sections have the same section modulus, and hence it is desirable that both mast sections have the same section modulus.

It should be recognized that the mathematical analysis given above applies properly to the embodiment of FIG. 5, but not rigorously to FIGS. 1-3 when the carriage is at low elevations, as for example, in FIG. 3 when the upper carriage rollers(27*a*)descend below the upper rollers (9*b*) of the fixed mast, and during such conditions bending moments in the elevatable mast section can exceed those given by formulas stated above; however, mast stresses and deflections are ordinarily of greater concern when the carriage is at higher elevations.

When the carriage is at low positions the bending moment $M_u$ in the elevatable mast section 23 can exceed the ideal value (Rh/2) given by use of equation (11), by a maximum factor of $(2-(h/l)$, where l is the vertical distance between the sets of rollers (9,24) which intercouple the two mast sections, and h is the vertical distance between the upper and lower carriage rollers. When the mast is nearly fully retracted, the distance l will approximate the lengths of the two mast sections in most applications, of course. A maximum bending moment will occur in mast section 23 when the mast is substantially fully retracted and the carriage 25 is substantially but not quite fully lowered, such as when the forks on the carriage are an infinitesimal distance above the floor, for example. That maximum moment will occur in elevatable section 23 at the level where it is engaged by the upper carriage rollers 27*a*,27*b*. The maximum magnitude of moment $M_L$ in the fixed mast section is the same amount as that which occurs during carriage-raised conditions. The bending moment in fixed section 21 deflects the top of the fixed section forwardly, as shown in grossly-exaggerated fashion in FIG. 6*c*. Conversely, the elevatable section 23 will be deflected top-backwardly, or convexly as viewed from the forks, but since the upper end of the elevatable section is positioned by the rollers 9 at the forwardly-deflected upper end of the fixed mast section, the net deflection at the top of the elevatable section from the vertical will be forward, as exaggeratedly depicted in FIG. 6*c*. The combination of forward displacement of the top of the fixed mast section with the rearward bending of the elevatable section will be seen to cause a slope (shown as angle $\alpha$ in FIG. 6*c*) of the lower portion of the elevatable section supporting the carriage 25, and a consequent downward drooping of the forks, also depicted in FIG. 6*c* in exaggerated form.

Although mast deflection and carriage tilt are normally of greater concern when the load carriage is at much higher elevations, and the invention solves that problem, it is desirable in some applications of the invention also to reduce or limit moments and carriage tilt at lower carriage elevations, and that may be accomplished by an addition to or modification of the invention depicted in FIGS. 6*a* and 6*b*. The elevatable mast section 23 comprises a pair of I-sections, only one of which is shown at 23*b*. The two I-sections which form elevatable mast section 23 are joined by cross-tie members, one of which is shown at 23*c*. The fixed or lower mast section 21 is also assumed to comprise a pair of I-sections, one of which is shown at 21*b*, and the I-sections forming the lower mast section 21 are interconnected by cross-tie members, one of which is shown at 21*c*. The cross-tie members 21*c* of the fixed section 21 are arranged to extend horizontally behind the fixed mast I-sections, allowing the elevatable section 23 to raise and lower without its cross-tie members 23*c* striking those of the fixed mast section, and providing sufficient space to mount a pair of rollers on the elevatable section, one such roller being shown at 10*b*. Roller 10*b* on the elevatable section 23 is shown engaging the back of the rear flange of fixed mast I-section 21*b*, and, of course, a similar roller (10*a*, not shown) on the other end of cross-tie 23*c* engages the other I-section of the fixed mast in similar fashion.

The rearward location of roller 10*b* on the elevatable section is preferably made adjustable over a short distance, so that dimension d in FIG. 6*a* can be varied. The roller 10*b* may be simply mounted eccentrically or off-center in an outer hub 10*e* so that rotation of the outer hub moves the roller slightly fore and aft, after which the outer hub is locked in position on the elevatable mast section, by means of a set screw 10*f*, for example. Roller 10*b* and its counterpart on the other side of the elevatable mast section are preferably mounted on the ends of a cross-tie member 23*c* of the elevatable section, but it will be apparent that they could be positioned at a higher or lower elevation on the elevatable section using simple mounting brackets.

With added rollers provided on the elevatable section as shown in FIGS. 6*a* and 6*b*, when the carriage approaches a fully lowered condition the added rollers transmit forces between the two mast sections, tending to greatly reduce the deflections which were shown in exaggerated form in FIG. 6*c*. The rollers riding against the back of the fixed mast section apply both a forward force $F_1$ (FIG. 6*c*) to the fixed mast section and an equal rearward force $F_2$ to the elevatable mast section, thereby tending to "straighten" both mast sections and reduce the tilting of the carriage.

Inasmuch as maximum displacement between the two mast sections in the absence of the added rollers tends to occur approximately halfway up those mast sections when the carriage is nearly fully lowered, it is deemed preferable to mount roller 10*b* and its counterpart (10*a*, not shown) approximately midway between the upper and lower ends of the elevatable mast section 23. As the mast is extended and carriage is lifted to high elevations, the added rollers rise above the upper end of the fixed mast, of course, and have no effect on mast deflections. The mentioned fore and aft adjustment of the added rollers allows one to adjust the amount of force which they transmit between the two mast sections. By adjustment of the forces applied by the added rollers, the maximum bending moment which occurs in the elevatable mast section when the mast is substantially fully lowered can be reduced to and even below the ideal $M_u$ value which occurs during elevated conditions using the relationship given in equation (11). As the lowering of the carriage causes the added rollers to transmit increasing straightening force between the two mast sections, the roller (9*a*, 9*b*, FIG. 3) forces at the upper end of the fixed mast section are decreased, and the roller (24, FIG. 3) forces at the lower end of the elevatable mast section are increased. The maximum amount of straigntening force which the added rollers can transmit between the two mast sections will be increased if the positions of the added rollers are adjusted to decrease dimension d in FIG. 6*a*. That dimension in general cannot be made smaller than the rear flange thickness of the fixed mast sections (e.g. 21*b*), or else the added rollers would be blocked by the rear flanges of those sections as the mast is retracted. It is possible to cause the added rollers to transmit greater straightening forces between the two mast sections, by arranging dimension d to vary with mast extension, providing ramps along the rear sides of the fixed mast members, for example, such as the ramp shown in dashed lines at 50 in FIG. 6*b*, although it is believed that such techniques will be deemed quite unnecessary in most applications of the invention.

Although a single pair of added rollers mounted approximately halfway up the elevatable section is deemed sufficient for most applications, it is possible and within the scope of the invention to provide further similar pairs of rollers (not shown) at other elevations on the elevatable section. The mounting of any such further rollers should be selected, however, so that they do not engage the fixed mast section to apply appreciable forces to it unless the upper carriage rollers (e.g. 27*a* in FIG. 3) are below the rollers (e.g. 9*b*) at the upper end of the fixed mast section 21.

In FIG. 7*a* the mast is diagrammatically shown substantially fully retracted. The load carriage applies roller forces R,R, or a force couple Rh, to the elevatable section, roller forces P,P act between the two mast sections, and a rearward moment M is assumed to be applied to the top of the elevatable section as the net result of the chain and ram forces acting on the elevatable section. With truck parameters established according to equation (11), the magnitude of rearward moment M will equal Rh/2. The bending moments in the fixed and elevatable sections under such conditions are plotted in FIG. 7*a*, which assumes the added rollers (10*a*, 10*b*) described in connection with FIGS. 6*a* and 6*b* are not employed. While the maximum bending moment in the fixed section does not exceed that of moment M, the maximum moment $M_1$ occurring in the elevatable section at the level of the upper carriage rollers does substantially exceed that magnitude. The magnitude of $M_1$ becomes a maximum when the mast is substantially fully retracted as diagrammatically shown, and it decreases as the mast is extended to raise the carriage. Bending moments in the fixed mast are in the same direction along its entire length, and the bending moments in the elevatable section are undesirably large. These factors combine to produce bending of the nature shown in exaggerated fashion in FIG. 6*c*.

FIG. 7*b* assumes that the added rollers journalled on the elevatable section to engage the fixed mast transmit forces F,F between the two mast sections. In FIG. 7*b* the forces F,F are assumed to be of the magnitude which urges the fixed section forwardly and the elevatable section rearwardly just enough that the roller forces at the upper ends of the two mast sections become zero. The magnitude of forces F,F is determined, of course, by the fore and aft adjustment of the added rollers, as previously explained. With such added roller forces zero bending moment occurs along the upper portion of the fixed mast section, greatly reducing its forward deflection, and lesser bending moments occur in the elevatable section, also reducing its rearward or convex deflection, and thus both mast sections will extend more nearly vertically. In FIG. 7*c* even greater forces B,B are assumed to be applied by the added rollers. The roller forces C,C at the upper ends of the two mast sections are then reversed. An upper portion of the fixed section has bending moments tending to bend it rearwardly, compensating for the bending occurring in the lower portions of that mast section, and the bending moments in the elevatable section are still further reduced. In FIG. 7*c* the magnitude of the roller forces B is equal to the sum of the roller forces A and C. When the added rollers transmit force between the two mast sections, the mast becomes statically indeterminate, so that general expressions for the force relationships become very unwieldy, except for special cases such as those described in connection with FIGS. 7*b* and 7*c*. Hence it should be understood that it is not necessary that the added rollers be adjusted specifically to provide zero roller force at the top of the retracted mast or specifically to provide reverse bending moments in the fixed mast, although such arrangements might be preferred in some applications.

While each of the masts described thus far has been shown as comprising a plural-section mast along which a load carriage is raised and lowered by means of one or more extensible hydraulic rams, it should be understood that the major principles of the invention are applicable as well to single-section masts supporting load carriages which are raised and lowered by other means, such as by a hoist drum, for example, such arrangements being used with various stacker crane vehicles. In FIG. 8 a mast M assumed to comprise a pair of laterally spaced vertical members affixed to a vehicle base guides vertical movement of load carriage LC. The carriage is suspended on the mast by cable means trained over pulley means at the top of the mast. It is apparent that either one or a pair of laterally-spaced apart cables can be used, and that either one or two courses of cable can lead to hoist drum HD. The bending moments in mast M above and below carriage LC may be made equal in magnitude and opposite in direction, as diagrammatically indicated in FIG. 8, if the rearward placement b of the vertical cable course(s) leading to hoist drum HD is related to the forward cable placement dimension f in accordance with $$b = \frac{f}{2} + \frac{W_c x_o + W_L x_L}{2(W_c + W_L)} \tag{12}$$

which corresponds to equation (11) with ram distance c and elevatable mast weight $W_m$ set at zero, by virtue of no ram or rams nor an elevatable mast being used in the arrangement depicted in FIG. 8. If two cables are used, they may cross laterally in order to reduce lateral bending moments in accordance with the teachings of prior U.S. Pat. No. 3,830,342. In the appended claims the terms "cable" and "cable means" are used in a generic sense to embrace either cables or chains or equivalent means.

It will thus be seen that the objects set forth above, among those made apparent from the preceding description, are efficiently attained, and since certain changes may be made in the above constructions without departing from the scope of the invention, it is intended that all matter contained in the above description or shown in the accompanying drawings shall be interpreted as illustrative and not in a limiting sense.

The embodiments of the invention in which an exclusive property or privilege is claimed are defined as follows:

1. In a lift truck mast assembly which includes a vertically-extending mast having pulley means journalled on said mast adjacent the upper end of said mast, a load carriage guided for vertical movement by said mast, lift cable means connected to said load carriage and trained over said pulley means to suspend said load carriage on said mast, said load carriage being adapted to carry a load with the center-of-gravity of said load horizontally displaced from said mast on a forward first side of said mast whereby said load carriage applies a force couple to said mast, said lift cable means including at least one first vertical course extending between said pulley means and said load carriage on said first side of said mast and at least one second vertical course extending between said pulley means and means vertically fixed with respect to said mast on a second rearward side of said mast opposite from said first side, the improvement which comprises said second vertical course being spaced sufficiently rearwardly from said mast that a maximum rated load on said carriage causes the maximum bending moment occurring in the portion of said mast below said force couple to be within 70% to 130% of the magnitude of and opposite in direction to the maximum bending moment occurring in the portion of said mast above said force couple.

2. The assembly according to claim 1 wherein said bending moments are substantially equal in magnitude and opposite in direction.

3. The assembly according to claim 1 wherein each of said bending moments is equal in magnitude to substantially one-half of said force couple applied to said mast by said load carriage.

4. The assembly according to claim 1 wherein said mast comprises a fixed mast section mounted on a base frame and an elevatable mast section guided for vertical movement by said fixed mast section, said pulley means being journalled on said elevatable mast section adjacent the upper end of said elevatable mast section, said second vertical course of said cable means extending between said pulley means and means vertically fixed with respect to said fixed section of said mast, and wherein said assembly includes extensible ram means connected to raise said elevatable mast section relative to said fixed mast section.

5. The assembly according to claim 1 wherein said mast is fixed vertically relative to a base frame, and wherein said assembly includes hoist drum means fixed vertically relative to said mast and located on said rearward side of said mast, said second vertical course of said lift cable means extending between said pulley means and said hoist drum means.

6. The assembly according to claim 1 wherein said mast includes first and second vertically-extending members spaced apart along a horizontal first axis defining said first and second sides of said mast and spaced on opposite sides of a horizontal second axis perpendicular to said first axis, wherein said lift cable means comprises first and second cables each trained by said pulley means to cross both said first axis and said second axis.

7. The assembly according to claim 1 wherein said fixed mast section includes first and second vertically-extending members spaced apart along a horizontal first axis separating and defining said first and second sides of said mast, wherein said maximum load has a weight $W_L$ and said center-of-gravity of said load is located a horizontal distance $x_L$ from said first axis, said load carriage has a weight $W_c$ and a center-of-gravity located a horizontal distance $x_o$ from said first axis, said first vertical course being located a horizontal distance f from said first axis and said second vertical course being located a horizontal distance b from said first axis, said pulley means being spaced to establish said distance b substantially in accordance with the relationship:

$$b = \frac{f}{2} + \frac{W_c x_o + W_L x_L}{2(W_c + W_L)}$$

8. The assembly according to claim 4 wherein said elevatable mast section comprises third and fourth vertically-extending members and wherein said extensible ram means is connected to said elevatable mast section forwardly of said third and fourth vertically-extending members.

9. The assembly according to claim 4 wherein said load carriage is guided for vertical movement by said elevatable mast section.

10. The assembly according to claim 4 wherein said load carriage is guided for vertical movement by said fixed mast section.

11. The assembly according to claim 4 wherein each of said mast sections has substantially the same section modulus.

12. The assembly according to claim 4 wherein said pulley means includes a plurality of pulleys, wherein said extensible ram means comprises first and second rams, and wherein each of said rams is connected to said elevatable mast section substantially directly below a respective one of said pulleys.

13. The assembly according to claim 4 wherein said fixed mast section includes first and second vertically-extending members spaced apart along a horizontal first axis separating and defining said first and second sides of said mast, wherein said elevatable mast section has a weight $W_m$, said maximum load has a weight $W_L$ and said center-of-gravity of said load is located a horizontal distance $x_L$ from said first axis, said load carriage has a weight $W_c$ and a center-of-gravity located a horizontal distance $x_o$ from said first axis, said ram means is connected to said elevatable mast section at a horizontal distance c from said first axis, said first vertical course being located a horizontal distance f from said first axis and said second vertical course being located a horizontal distance b from said first axis, said pulley means being spaced to establish said distance b substantially in accordance with the relationship:

$$b = \frac{f}{2} - 2c + \frac{W_c x_o + W_L x_L - 2W_m c}{2(W_c + W_L)}$$

14. The assembly according to claim 4 wherein said fixed mast section includes first and second vertically-extending members spaced apart along a horizontal first axis defining said first and second sides of said mast, said lift cable means being trained to cross said first axis, and wherein said extensible ram means is connected to said elevatable mast section forwardly of said vertically-extending members of said fixed mast section.

15. The assembly according to claim 4 wherein said fixed mast section includes first roller means journalled adjacent the upper end of said fixed mast section to engage said elevatable mast section substantially throughout vertical movement of said elevatable mast section relative to said fixed mast section, said elevatable mast section including second roller means journalled adjacent the lower end of said elevatable mast section to engage said fixed mast section throughout vertical movement of said elevatable mast section, and third roller means journalled on said elevatable mast section intermediate the upper and lower ends of said elevatable mast section to engage said fixed mast section when said elevatable mast section is within a range of lowered positions relative to said fixed mast section, and to disengage from said fixed mast section when said elevatable mast section is raised above said range of lowered positions.

16. The assembly according to claim 4 wherein said fixed mast section includes first roller means journalled on said fixed mast section adjacent the upper end thereof, said elevatable mast section includes second roller means journalled on said elevatable mast section adjacent the lower end thereof, said first roller means engaging said elevatable mast section and said second roller means engaging said fixed mast section to guide said elevatable mast section for vertical movement, said load carriage including third roller means engaging said elevatable mast section to guide said carriage for vertical movement and transmitting said force couple to said elevatable mast section, said elevatable mast section including fourth roller means journalled on a portion of said elevatable mast section intermediate the upper and lower ends of said elevatable mast section to be elevatable above and lowerable below the upper end of said fixed mast section, and operable upon being lowered below said upper end of said fixed mast section to engage said fixed mast section, urging said portion of said elevatable mast section rearwardly and urging portions of said fixed mast section forwardly.

17. A lift truck mast assembly, comprising, in combination: a fixed first mast section which includes first and second vertically-extending members mounted on a base frame and spaced apart along a horizontal axis extending in a lateral direction; an elevatable second mast section guided for vertical movement by said fixed mast section and carrying pulley means; a carriage adapted to carry a load with the center-of-gravity of the load located on a forward side of said axis; lift chain means, said carriage being suspended from said second mast section by said lift chain means to be raised and lowered as said second mast section is raised and lowered, said carriage being guided for vertical movement by and operable to apply a force couple to one of said mast sections; and lifting means connected to raise said second mast section, said lift chain means being connected to said carriage forwardly of said axis, being trained over said pulley means to cross said axis, and being anchored to means fixed vertically with respect to said base frame rearwardly from said axis at a sufficient distance from said axis that a maximum rated load on said carriage causes the maximum bending moment in either of said mast sections at points below said force couple to be within 70% to 130% of the magnitude of and opposite in direction to the maximum bending moment in either of said mast sections at points above said force couple.

* * * * *